US006732376B2

(12) United States Patent
Hoffman

(10) Patent No.: US 6,732,376 B2
(45) Date of Patent: May 11, 2004

(54) HOCKEY GLOVE WITH ATTACHABLE PROTECTOR

(75) Inventor: Justin Hoffman, Rancho Santa Margarita, CA (US)

(73) Assignee: Mission Hockey Company, Santa Ana, CA (US)

( * ) Notice: Subject to any disclaimer, the term of this patent is extended or adjusted under 35 U.S.C. 154(b) by 0 days.

(21) Appl. No.: 10/337,020

(22) Filed: Jan. 6, 2003

(65) Prior Publication Data

US 2003/0163862 A1 Sep. 4, 2003

Related U.S. Application Data

(60) Provisional application No. 60/346,017, filed on Jan. 4, 2002.

(51) Int. Cl.[7] ..... A41D 19/00
(52) U.S. Cl. ..... 2/161.1
(58) Field of Search ..... 2/16, 18, 19, 20, 2/159, 160, 161.1, 161.2, 161.6, 162, 170; 602/21, 22

(56) References Cited

U.S. PATENT DOCUMENTS

| | | | | |
|---|---|---|---|---|
| 2,293,347 | A | 8/1942 | Lindfelt | |
| 2,708,753 | A | 8/1955 | Kennedy | |
| 2,831,196 | A | 4/1958 | Schelber | |
| 3,387,306 | A | 6/1968 | Korey | |
| 3,626,515 | A | 12/1971 | Murray | |
| 3,994,024 | A | * 11/1976 | Bates | 2/19 |
| 4,272,849 | A | 6/1981 | Thurston et al. | |
| 4,411,024 | A | 10/1983 | Hayes | |
| 4,484,359 | A | 11/1984 | Tirinen | |
| 4,497,073 | A | 2/1985 | Deutsch | |
| 4,524,464 | A | 6/1985 | Primiano et al. | |
| 4,677,698 | A | 7/1987 | Angas | |
| 4,700,403 | A | 10/1987 | Vacanti | |
| 4,700,405 | A | 10/1987 | Sternberg | |
| 4,815,147 | A | 3/1989 | Gazzano et al. | |
| 4,930,162 | A | 6/1990 | Cote | |
| 5,107,544 | A | * 4/1992 | Capatosto | 2/16 |
| 5,232,436 | A | 8/1993 | Janevski | |
| 5,237,703 | A | 8/1993 | Brine et al. | |
| 5,329,639 | A | 7/1994 | Aoki | |
| 5,457,819 | A | * 10/1995 | Aoki | 2/19 |
| 5,488,739 | A | 2/1996 | Cardinal | |
| 5,511,243 | A | 4/1996 | Hall et al. | |
| D376,676 | S | 12/1996 | Chen | |
| 5,781,929 | A | 7/1998 | Shikatan | |
| 5,787,506 | A | 8/1998 | Wilder et al. | |
| D403,127 | S | 12/1998 | Castonguay et al. | |
| 5,884,329 | A | 3/1999 | Goldsmith et al. | |
| 5,983,396 | A | 11/1999 | Morrow et al. | |
| 5,996,117 | A | 12/1999 | Goldsmith et al. | |
| 6,013,044 | A | * 1/2000 | Estwanik | 602/64 |
| 6,233,744 | B1 | 5/2001 | McDuff | |
| 6,253,376 | B1 | * 7/2001 | Ritter | 2/24 |
| 6,490,737 | B1 | * 12/2002 | Mazzei et al. | 2/410 |
| 6,543,057 | B2 | 4/2003 | Beland et al. | |
| 6,557,177 | B2 | 5/2003 | Hochmuth | |
| 2003/0106131 | A1 | 6/2003 | Tremblay | |

FOREIGN PATENT DOCUMENTS

| | | |
|---|---|---|
| DE | 2842720 | 4/1980 |
| DE | 2843448 | 4/1980 |
| DE | 3135756 | 4/1983 |

OTHER PUBLICATIONS

BiltRite Advertisement; the Works Series Glove. Jun. 1998.

* cited by examiner

*Primary Examiner*—Gary L. Welch
(74) *Attorney, Agent, or Firm*—Knobbe, Martens, Olson & Bear, LLP.

(57) ABSTRACT

A protective sports glove comprises a body and a cuff. The body has a palm portion, typically four fingers, a thumb, and a back portion. The glove is preferably suitably padded to offer the player an adequate level of protection from impact type injuries during game play. One or more attachable protectors are selectively attachable to the glove. The arrangement of the attachable protector on the glove can be customized by the user. As such, the padding characteristics of the glove and attachable protector can be customized by selectively attaching the attachable protector as desired.

30 Claims, 11 Drawing Sheets

FIG. 1
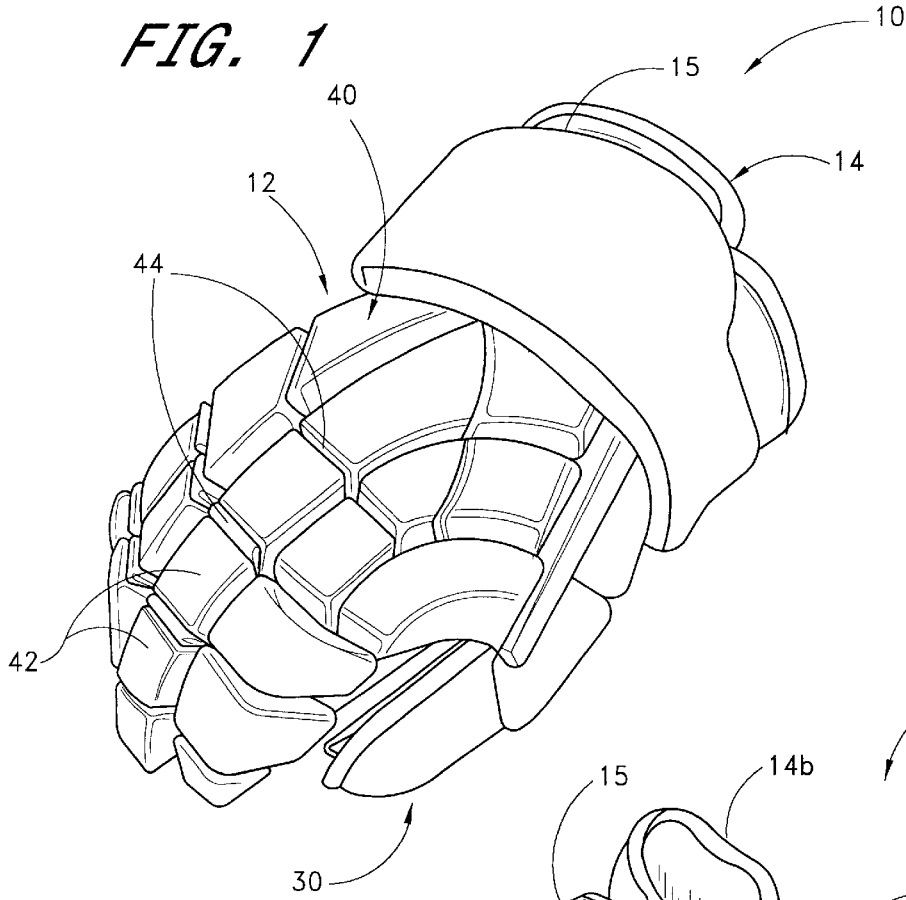
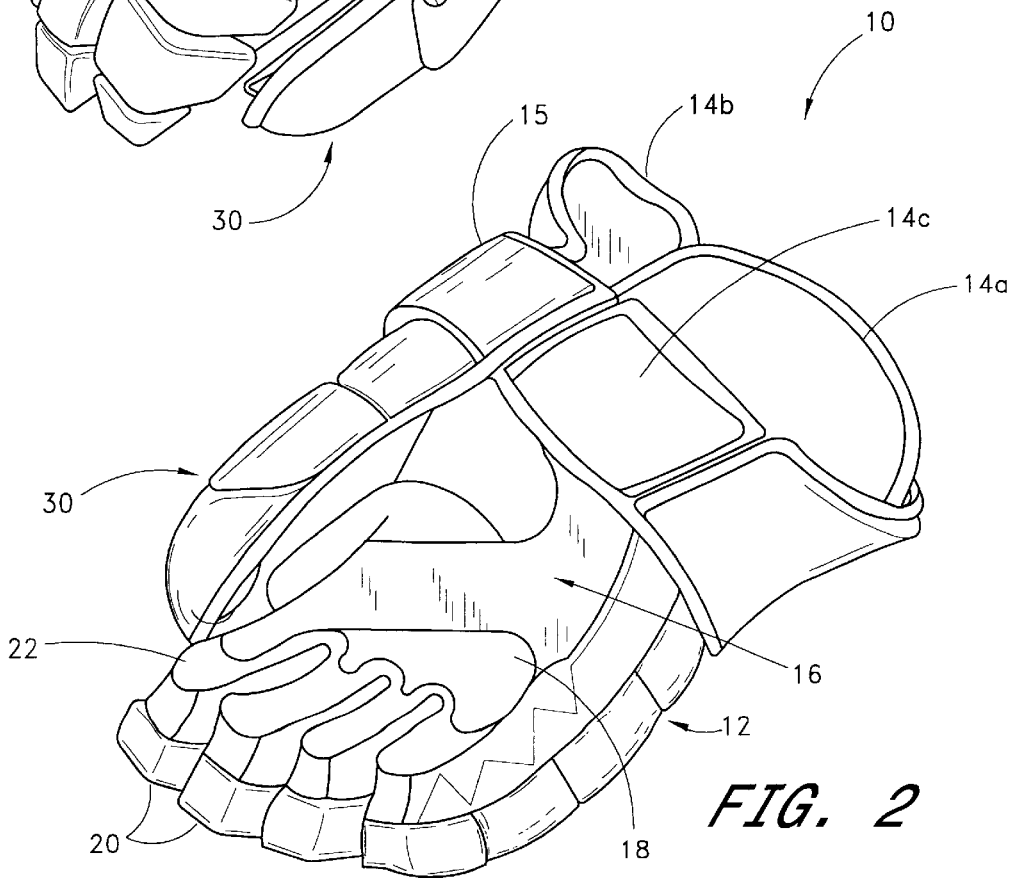
FIG. 2

HOCKEY GLOVE WITH ATTACHABLE PROTECTOR

RELATED APPLICATION

This application claims priority to U.S. provisional patent application serial No. 60/346,017, filed on Jan. 4, 2002, the entirety of which is hereby expressly incorporated by reference.

FIELD OF THE INVENTION

The present invention relates to protective gear for use during contact sports. More specifically, a novel glove is disclosed having removable and/or reconfigurable protective attachments.

BACKGROUND OF THE INVENTION

Ice hockey is a fast-moving, competitive game involving extensive contact between players and implements. Thus, hockey players typically wear an extensive amount of padding while playing. A player's hands are responsible for controlling and manipulating a hockey stick to advance a puck down the ice toward an opponent's goal. Accordingly, one particularly effective defensive strategy is to impact an opponent's stick to prevent the player from passing and shooting the puck unopposed. Unfortunately, due to the fast-paced nature and typical aggressiveness of game play, players are not always careful when slashing at other players, and hence, a player's hands oftentimes receive a blow from an opponent's stick. Moreover, game play can be aggressive, with players getting checked into the boards or falling onto the playing surface. Therefore, players wear protective gloves to protect their hands and wrists from impact injuries, such as those from the boards, the playing surface, and especially from opponent's sticks.

Hockey players generally hold the hockey stick with an upper hand near the butt of the stick and a lower hand gripping the shaft nearer the blade. A typical right-handed hockey player will use his left hand to backhand grasp the stick near the butt of the shaft. This left hand is the main hand for holding the stick and acts to provide stability to the player's grip. Additionally, this upper hand acts as a pivot point about which the blade of the stick moves, such as for shooting or passing the puck. This upper hand is thus the main stick gripping component of the player's grip.

A right-handed hockey player generally positions his right hand in a forehand grip on the shaft of the stick closer to the blade. This lower hand acts as the main power generator and controller of the hockey stick. The player uses this lower hand to generate power during shots and slashing movements, as well as manipulating the stick during passing, receiving, and advancement of the puck. This lower hand is thus the main stick controlling component of the player's grip.

Because of their differing positions, postures, and purposes, the upper and lower hands tend to grip the hockey stick from different perspectives. For instance, during play, the lower hand is wrapped around the stick with the palm facing generally upward and slightly to the side. In contrast, the upper hand typically has its palm facing generally downward. Because of these opposing orientations, the upper and lower hands and wrists tend to be impacted differently during play.

SUMMARY OF THE PREFERRED EMBODIMENTS

According to one embodiment of a hockey glove with attachable protector, a sports glove system comprises a right glove and a left glove. Each glove comprises a palm, a protective back extending over the palm, padding, and a glove attachment member. Additionally, the sports glove system comprises a plurality of attachable protectors that are formed separately from the gloves. Each of the attachable protectors comprise an attachment member configured to cooperate with the glove attachment member to selectively and releasably hold the attachable protector onto the respective glove in a first orientation in which the attachable protector presents a first characteristic or in a second orientation in which the attachable protector presents a second characteristic.

Additionally, according to another embodiment, the attachable protectors each have a first surface and a second surface, with each attachable protector configured so that the first surface faces outwardly when the protector is held on the respective glove in the first orientation, and the second surface faces outwardly when the protector is held on the respective glove in the second orientation.

The first and second surfaces of the attachable protector can have different graphical characteristics. Additionally, the sports glove system can comprise a plurality of pairs of attachable protectors. The first pair of attachable protectors can have a different shape than a second pair of attachable protectors. Moreover, the first pair of attachable protectors can have a different stiffness, or can have a different graphical design, than a second pair of attachable protectors.

According to another embodiment, the attachable protectors comprise a first end and a second end and are asymmetrical about a midpoint between the first and second ends. Accordingly, such an embodiment can have a width adjacent its first end that is greater than a width adjacent its second end. As such, the first end of the attachable protector can be disposed generally adjacent a thumb of the respective glove when the protector is held to the glove in the first orientation. The second end of the attachable protector can be disposed generally adjacent the back of the respective glove when the protector is held to the glove in the first orientation.

According to another embodiment, a sports glove comprises a body having a palm, a back and a cuff, and an attachable protector configured to be selectively releasably connected to the body. The attachable protector has at least a first attachment member, first and second opposing surfaces, and first and second ends. The attachable protector covers at least a portion of the body.

Additionally, the first end of the attachable protector can be thicker and/or wider than the second end. Moreover, the first and second surfaces of the attachable protector can have different graphical characteristics.

In one embodiment, the attachable protector extends around a portion of the cuff. In another embodiment, the attachable protector first end is connected to the cuff, and the second end is connected to the glove a distance away from the cuff.

According to yet another embodiment, a method of customizing a sports glove comprises providing a glove having a palm and a protective back, providing an attachable protector configured for selective attachment to the glove in more than one orientation, and removably attaching the attachable protector to the glove so that the attachable protector is oriented in a first orientation.

The attachable protector can be subsequently removed and reattached to the glove in a second orientation. Additionally, the attachable protector can be removed and a second attachable protector having different properties than the first attachable protector can be removably attached.

BRIEF DESCRIPTION OF THE DRAWINGS

FIG. 1 is a perspective view of a hockey glove, viewed with the palm side down.

FIG. 2 is a perspective view the hockey glove of FIG. 1, viewed with the palm side up.

DETAILED DESCRIPTION OF PREFERRED EMBODIMENTS

Figure 3:
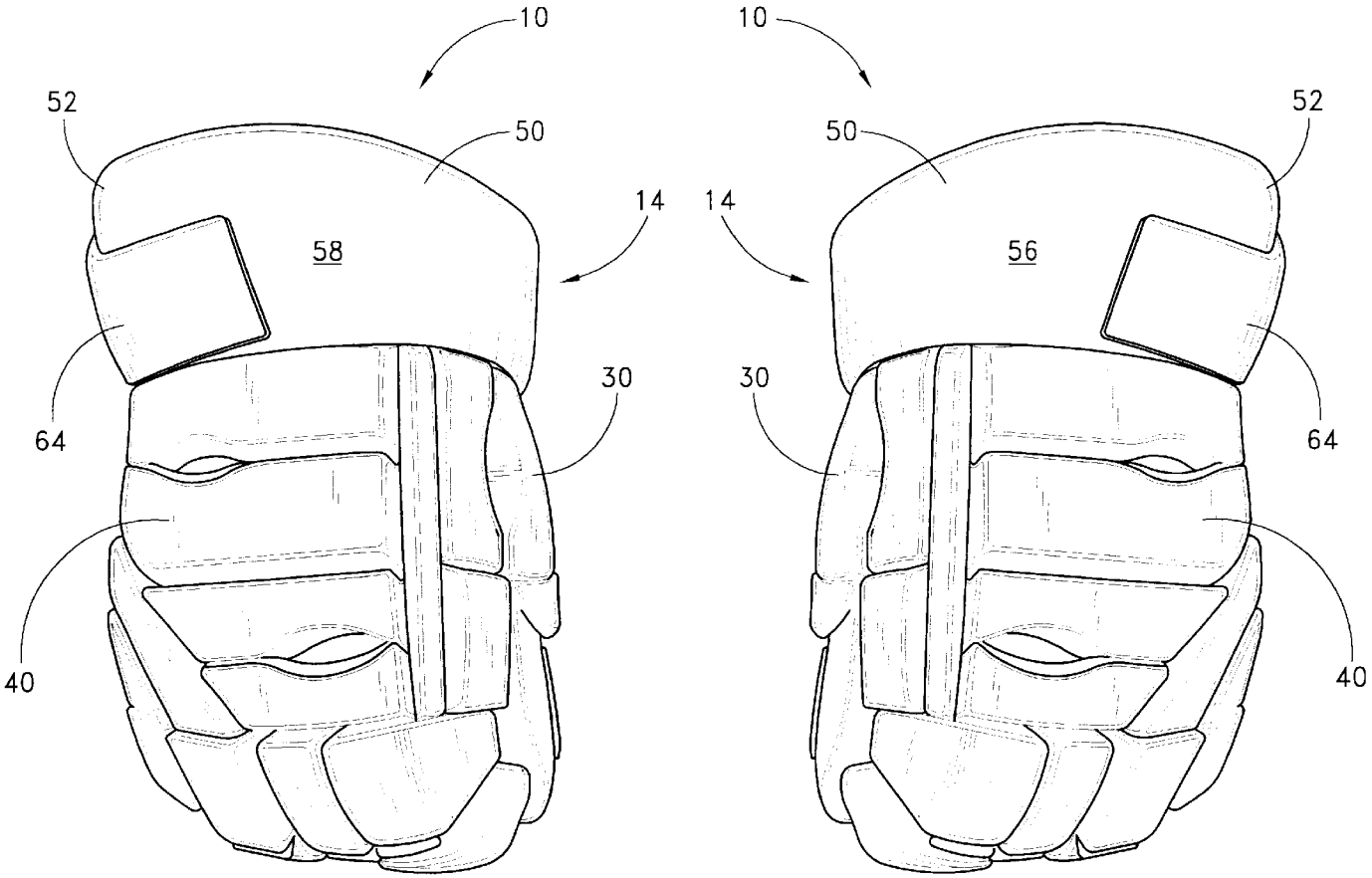
FIG. 3 illustrates one embodiment of a pair of gloves having a pair of attachable protectors attached to and generally covering a cuff portion of the gloves.

With first reference to FIGS. 1 and 2, an examplary right hand hockey glove 10 is shown. Hockey is but one examplary sport for which the glove improvements disclosed herein are applicable. For example, gloves having aspects disclosed herein are also suitable for other stick wielding sports, such as Lacrosse. As such, neither this disclosure nor the claims appended hereto should be specifically limited to the sport of hockey, but should be read broadly in the context of all appropriate stick-wielding contact sports. However, the remainder of the disclosure will use hockey as the illustrative, and not limiting, sport.

The hockey glove 10 illustrated in FIGS. 1 and 2 generally comprises a body 12 and a cuff 14. The body 12 has a palm portion 16, typically four fingers 20, a thumb 30, and a back 40. Finger gussets 22 are formed in the fingers 20 for receiving the wearer's fingers therein.

The palm portion 16 of the body 12 extends to cover the palm-side of the thumb and fingers of the wearer's hand. The palm 16 of the glove is typically susceptible to abrasion, such as from holding the hockey stick. Accordingly, the palm 16 is preferably formed of split leather or synthetic leather selected for durability and comfort and can be attached through any suitable process, but typically stitching is used. In some embodiments, reinforcing gripping sections 18 of material, such as textured synthetic leather, are provided on the palm 16 or fingers 20 to improve gripping ability and provide reinforcement at those locations that tend to commonly abrade.

The back 40 of the glove 10, including the backs of the fingers 20, includes a plurality of padding segments 42, which may be formed of relatively thick foam sandwiched between an inner liner and an outer cover. These segments 42 are preferably formed by waffle-type foam material processed in any suitable manner. The inner liner typically comprises foam covered on both sides by nylon. The foam segments 42 are designed for durability and durometer to effectively protect the hand during the rigors of game play. Preferably, the foam outer cover is leather, or a suitable synthetic material such as DuPont Cordura™ nylon, manufactured by E.I. du Pont de Nemours and Company.

The foam segments 42 of the back 40 are formed and grouped to substantially conform to the shape of the back of the hand and fingers of a player. The segments 42 on the fingers 20 are preferably formed to curve slightly to imitate a relaxed position of the wearer's hand. In one embodiment, this is accomplished by providing a break line 44 in between the segments 42. For example, a break line 44 is formed transverse to a longitudinal axis of the glove at a location that substantially corresponds with the knuckles of the fingers and hand to allow the glove to respond to hand and finger movements.

A cuff 14 is connected to a proximal side of the glove 10 and extends generally proximally from the palm 16, thumb 30, and back 40 of the glove. In the illustrated embodiment, the cuff 14 has back, thumb, and palm portions 14*a*, 14*b*, 14*c*.

With continued reference to FIGS. 1 and 2, a cuff pad 15 is disposed over at least a portion of the cuff 14. The cuff pad 15 is preferably constructed of foam, and provides further protection for the wearer. In the illustrated embodiment, the cuff pad 15 extends generally around the proximal side of the glove 10, extending from the thumb 30, around the back 40 and to the palm 16.

The embodiment described in FIGS. 1 and 2 depicts certain aspects of an example hockey glove. This glove, and an associated sports glove system, is discussed more fully in copending U.S. application Ser. No. 09/420,738, filed Oct. 20, 1999, titled "Asymmetrical Hockey Glove System with Articulated Locking Thumb", the entirety of which is hereby incorporated by reference.

With reference next to FIG. 3, another embodiment of a pair of hockey gloves 10 are shown. In the illustrated embodiment, an attachable protector 50 generally covers the cuff portion 14 of each glove 10 to provide protection to a player's hands and wrists. Each attachable protector 50 is selectively attachable to the respective glove 10, as will be discussed in further detail below.

Figure 4:
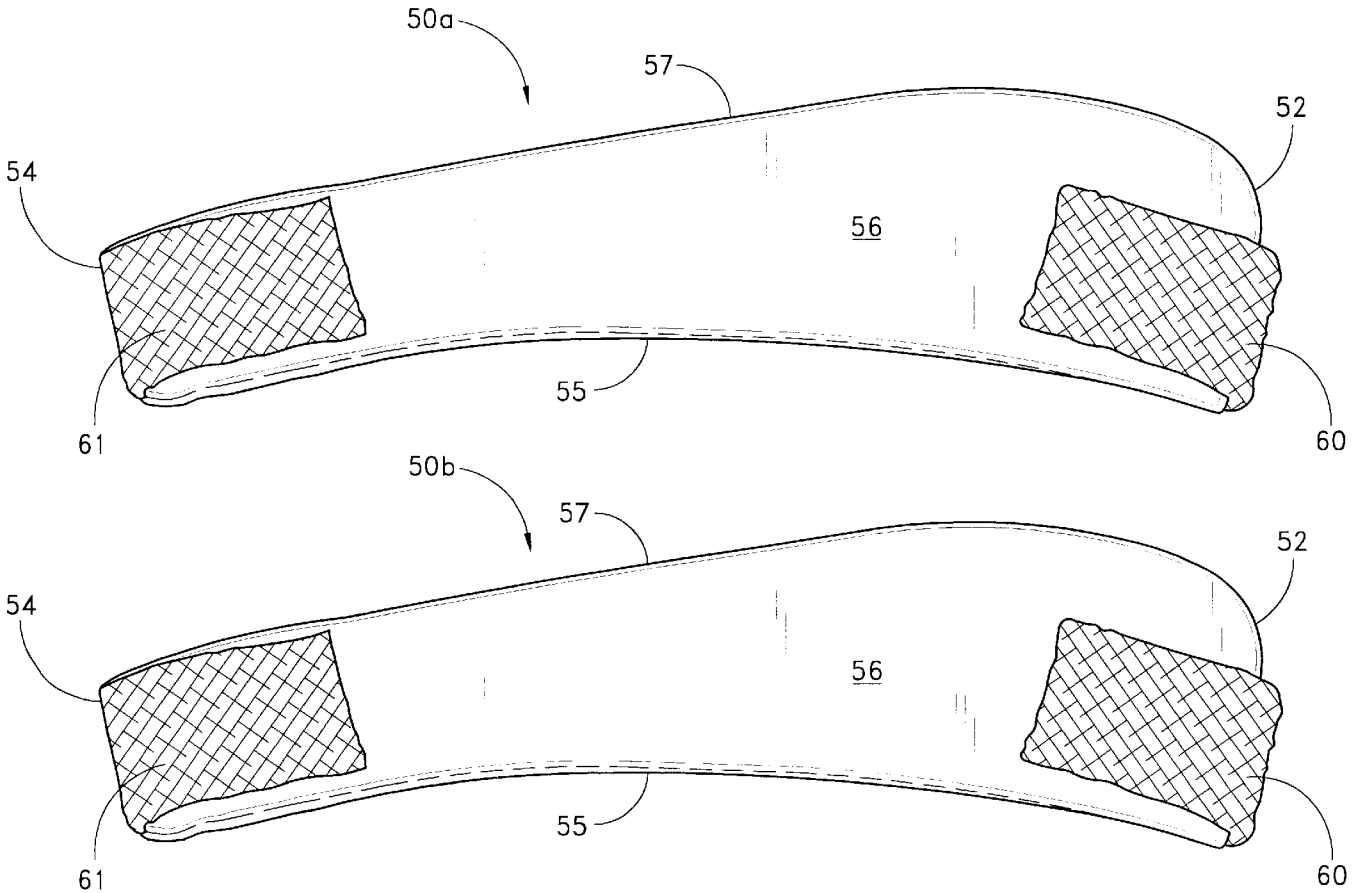
FIG. 4 illustrates a pair of attachable protectors, showing a first surface of each protector.
Figure 5:
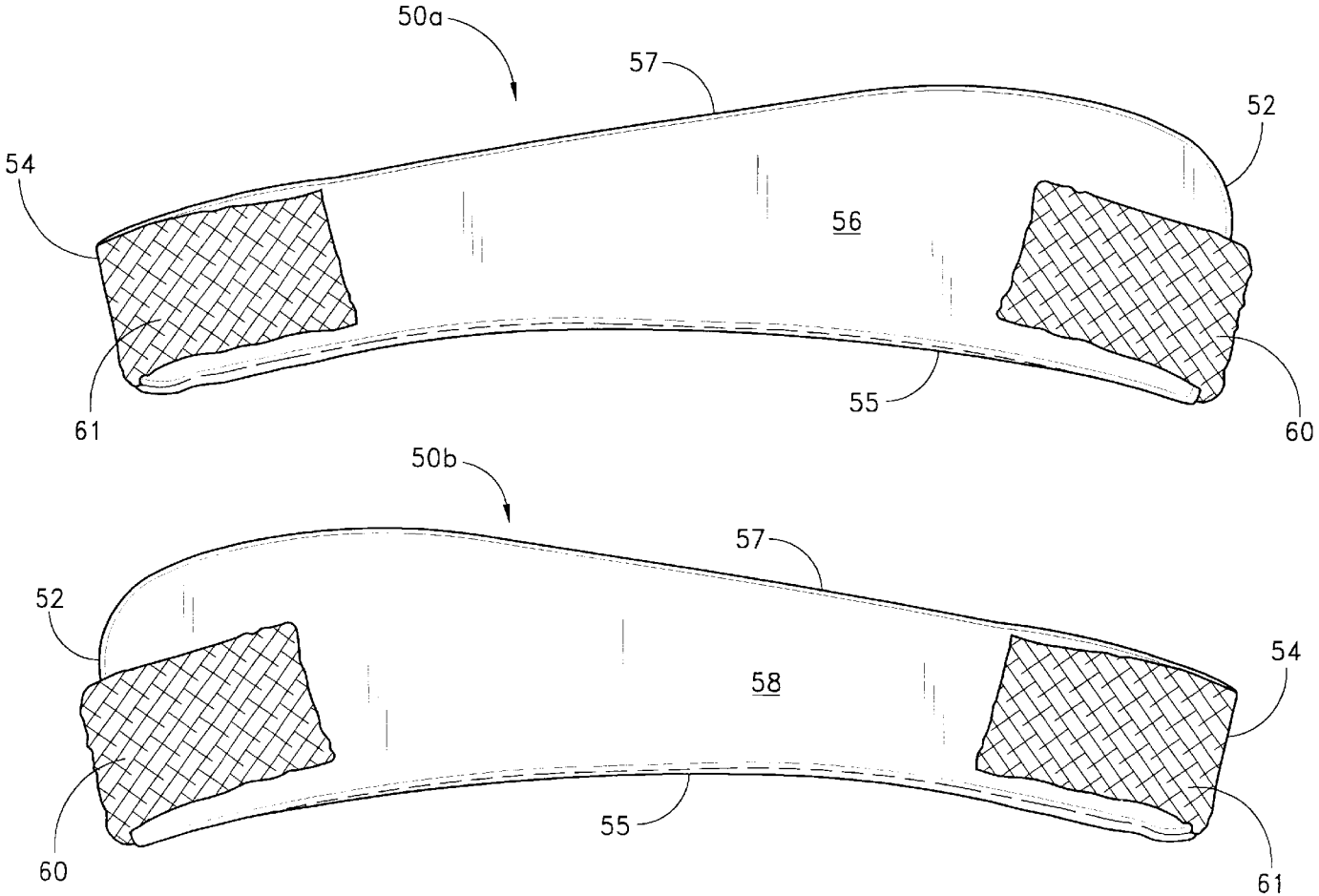
FIG. 5 illustrates a pair of attachable protectors, showing the first surface of one protector and a second surface of the other protector.

With next reference to FIGS. 4 and 5, the attachable protectors 50 of the gloves in FIG. 3 are shown removed from the gloves 10. In the illustrated embodiment, the attachable protectors 50*a, b* are elongate and have a first end 52 and a second end 54. A first edge 55 and a second edge 57 extend between the ends 52, 54. A width is defined between the first and second edges 55, 57. The attachable protectors 50 further have a first surface 56 and a second surface 58. A thickness is defined between the first and second surfaces 56, 58.

The first end 52 has a desired width between the first edge 55 and the second edge 57 that is between about 1 inch to about 4 or more inches, and more preferably, within the range of from about 2 inches to about 3 inches, and in one preferred embodiment, is about 2½ inches wide. The second end 54 has a width that is preferably less than the width of the first end 52, and is within the range of from about ½ inch to about 3 inches, and in one embodiment, is about 1½ inches. In the illustrated embodiment, the first end is about 2½ inches wide and the second end is about 1½ inches wide.

In the illustrated embodiment, the first edge 55 follows a generally consistent curve about a radius of curvature, while the second edge 57 follows a different curvature and shape than the first edge 55. The width of the illustrated attachable protector 50 generally decreases in a smooth transition from the first end 52 toward the second end 54. As such, each illustrated attachable protector 50 is generally asymmetrical about a center axis equidistant from the first and second ends, 52,54. Of course, additional shapes are possible, as will be discussed below in more detail.

With continued reference to FIGS. 4 and 5, the first surface 56 and second surface 58 preferably are separated by a uniform-thickness impact absorbing material, which, in one embodiment, comprises padding. The padding can comprise foam or any other suitable type of padding that is efficient at absorbing shock and impact forces. In one preferred embodiment, the padding is formed of expanded polypropylene. The padding can be formed into any suitable size and shape.

Each attachable protector 50 has one or more mounting portions. In the illustrated embodiment, each attachable protector 50 carries a first mounting portion 60 on its first end 52, and a second mounting portion 61 on its second end 54. The mounting portion illustrated is a hook and loop fastener, popularly known as Velcro™. The first mounting portion 60 is configured to cooperate with a corresponding glove mount 62 (see FIGS. 6 and 7) located on the gloves to effectuate a secure mounting of the attachable protectors 50 at the desired location and orientation. With continued reference to FIGS. 4 and 5, the first mounting portion 60 is secured to the first surface 56 near the first end 52 of the attachable protector 50, and wraps around the first end 52 and is secured to the second surface 58 near the first end 52. Likewise, the second mounting portion 61 is secured to the first surface 56 toward the second end 54, wraps around the second end 54, and is secured to the second surface 58 near the second end 54 of the attachable protector 50.

Figure 6:
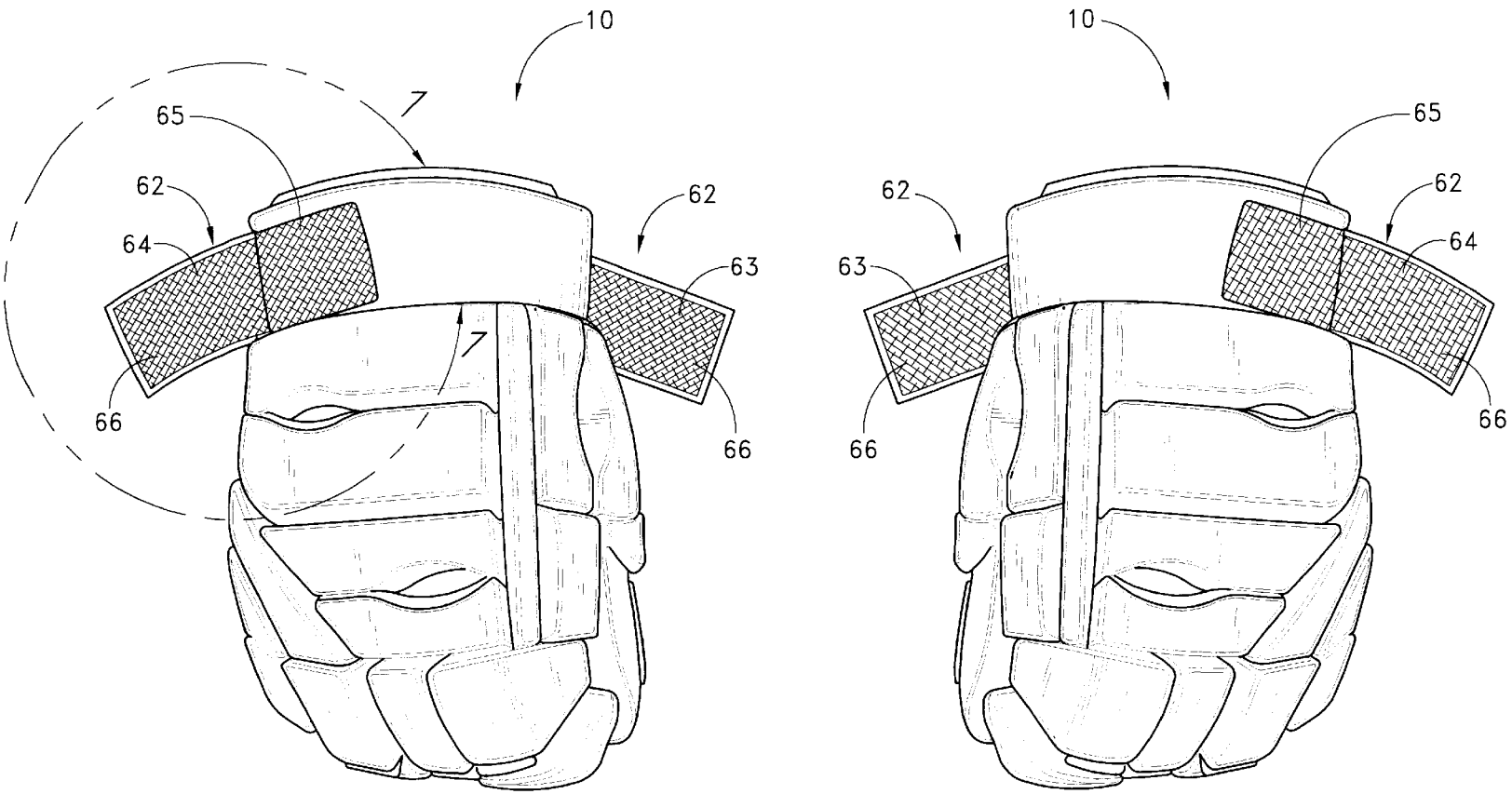
FIG. 6 illustrates a pair of hockey gloves having one embodiment of attachment devices for securing attachable protectors.
Figure 7:
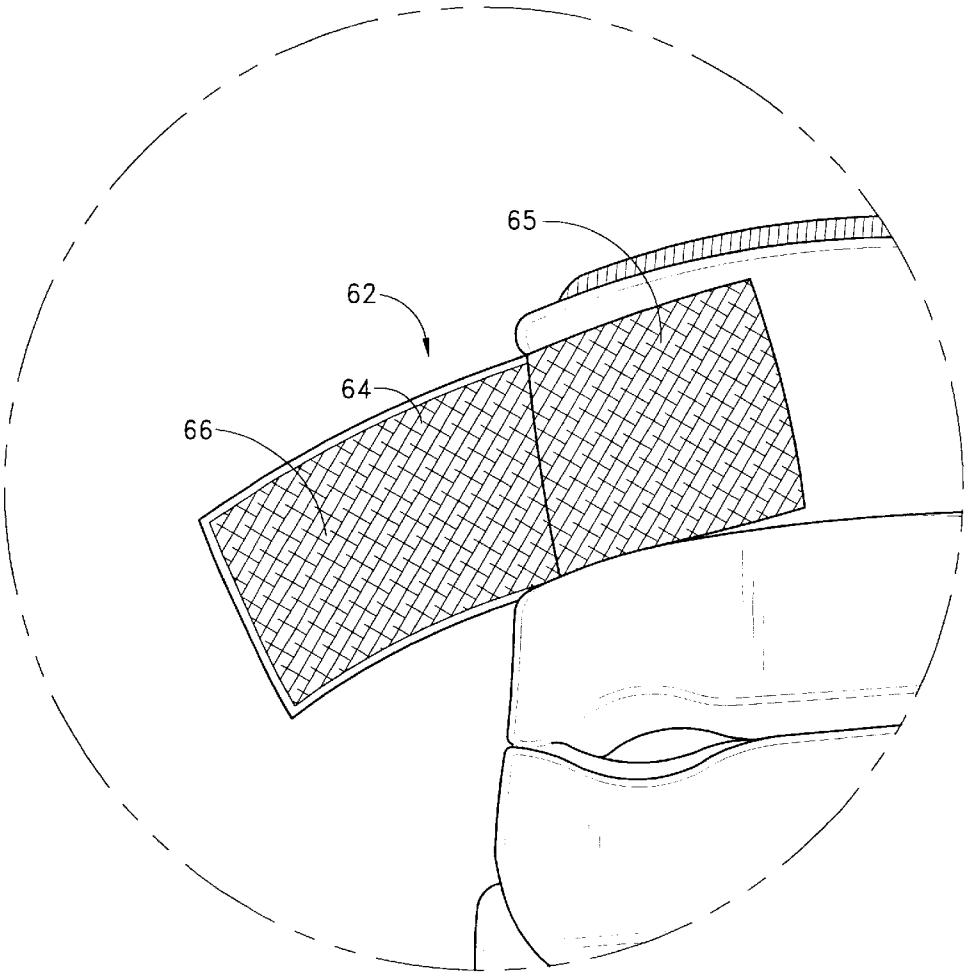
FIG. 7 is a close-up view of the right hand glove of FIG. 6 showing the attachment device in an open configuration.
Figure 8:
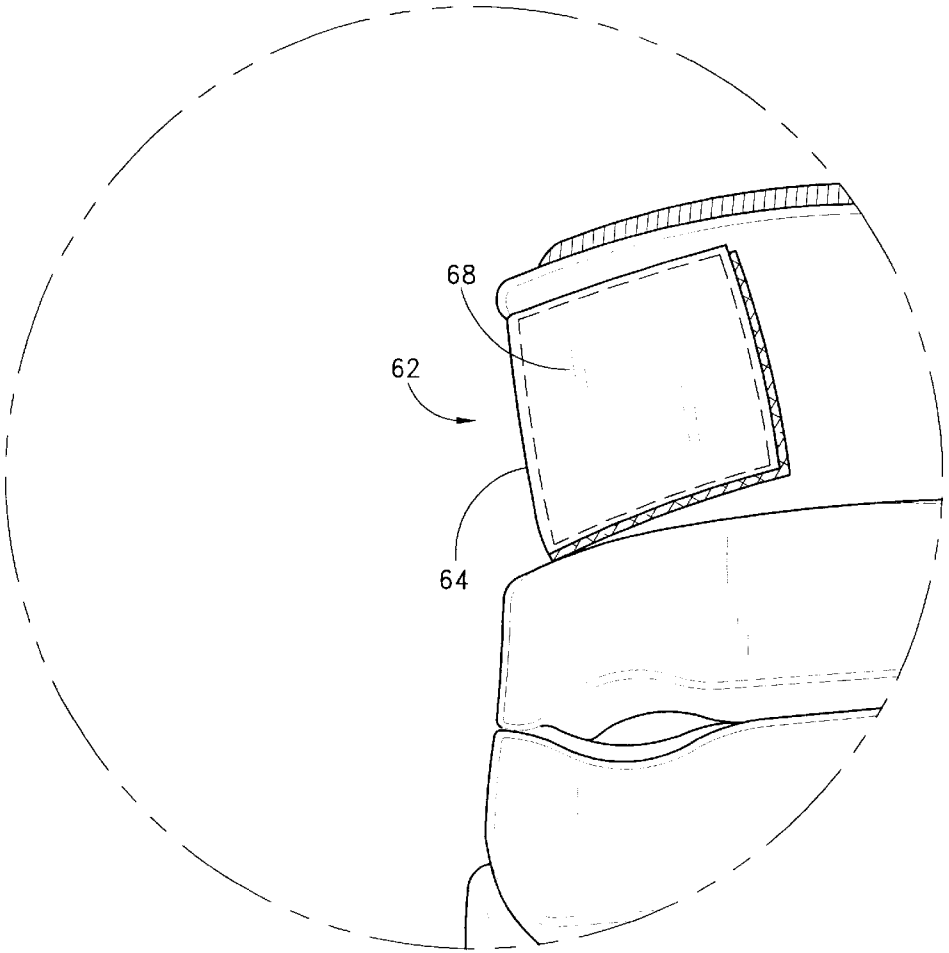
FIG. 8 shows the right hand glove of FIG. 7 with the attachment device in a closed configuration.

With reference to FIGS. 6–8, a pair of gloves 10 having glove mounts 62 are illustrated. Each glove 10 has two mounting portions 63, 64 attached thereto: a thumb mount 63 located on the thumb cuff 14*b* just anatomically proximal to the thumb 30, and a back mount 64 located on the back cuff 14*a* generally opposite the thumb 30. As discussed above, the glove mounts cooperate with the mounting portions 60,61 of the attachable protector 50. In the illustrated embodiment, the glove mounts comprise a fastening device, such as Velcro™, that enables selective attachment and orientation of the attachable protectors 50.

It will be understood that when using a hook and loop fastener, it does not matter which component the hook portion is attached to nor on which component the loop portion is attached. For simplicity, the remainder of this description will assume that the loop is attached to the glove 10 and the hook is attached to the attachable protector 50. The illustrated fastening device used to secure the attachable protector 50 onto the glove 10 is rugged enough to withstand the rigors of contact sports without failing or allowing premature detachment, which could result in an obstruction to the game and leaving the player vulnerable to injury in the absence of the protection offered by the attachable protectors 50.

In the illustrated embodiment, the glove mounts 62 comprise one or more strips of loop material comprising two sections. A fixed section 65 is securely attached to the glove, which may be by stitching; adhesives; chemical, mechanical, or heat bonding; or any other suitable method of attachment. A free section 66 hangs freely from the glove 10 and is foldable over the fixed section 65, as shown in FIG. 8. Preferably, the free section 66 comprises an appropriate backing 68, such as leather or other textiles used in the manufacture of the glove 10, to provide durability and aesthetics. The backing may be attached to the free section 66 in any suitable manner, but in one preferred embodiment, is attached with stitching. The backing may optionally be decorated, as desired.

To attach the attachable protectors 50 to the described glove mounts 63, 64, a player separates the fixed section 65 and the free section 66, thereby book-opening the sections along a fold line therebetween, inserts a mounting portion 60, 61 of an attachable protector, and closes the free section 66 over the mounting portion 60, 61. The mounting portion is thus sandwiched within the glove mount 62, resulting in a secure, yet selectively detachable, hold.

With reference again to FIG. 3, a pair of gloves is illustrated and configured so that the first end 52 of each of the attachable protectors is engaged with the back mount 64 of each glove. As such, the widest portion of the attachable protector is arranged adjacent the back 40 of each glove 10. Thus, more protection is provided adjacent the back 40 of the glove 10 than adjacent the thumb portion 30 of the glove 10. As shown, for the left-handed glove, the first surface 56 of its associated attachable protector 50 faces outward. Conversely, for the right-handed glove, the second surface 58 of the attachable protector 50 faces outwardly.

Figure 9:
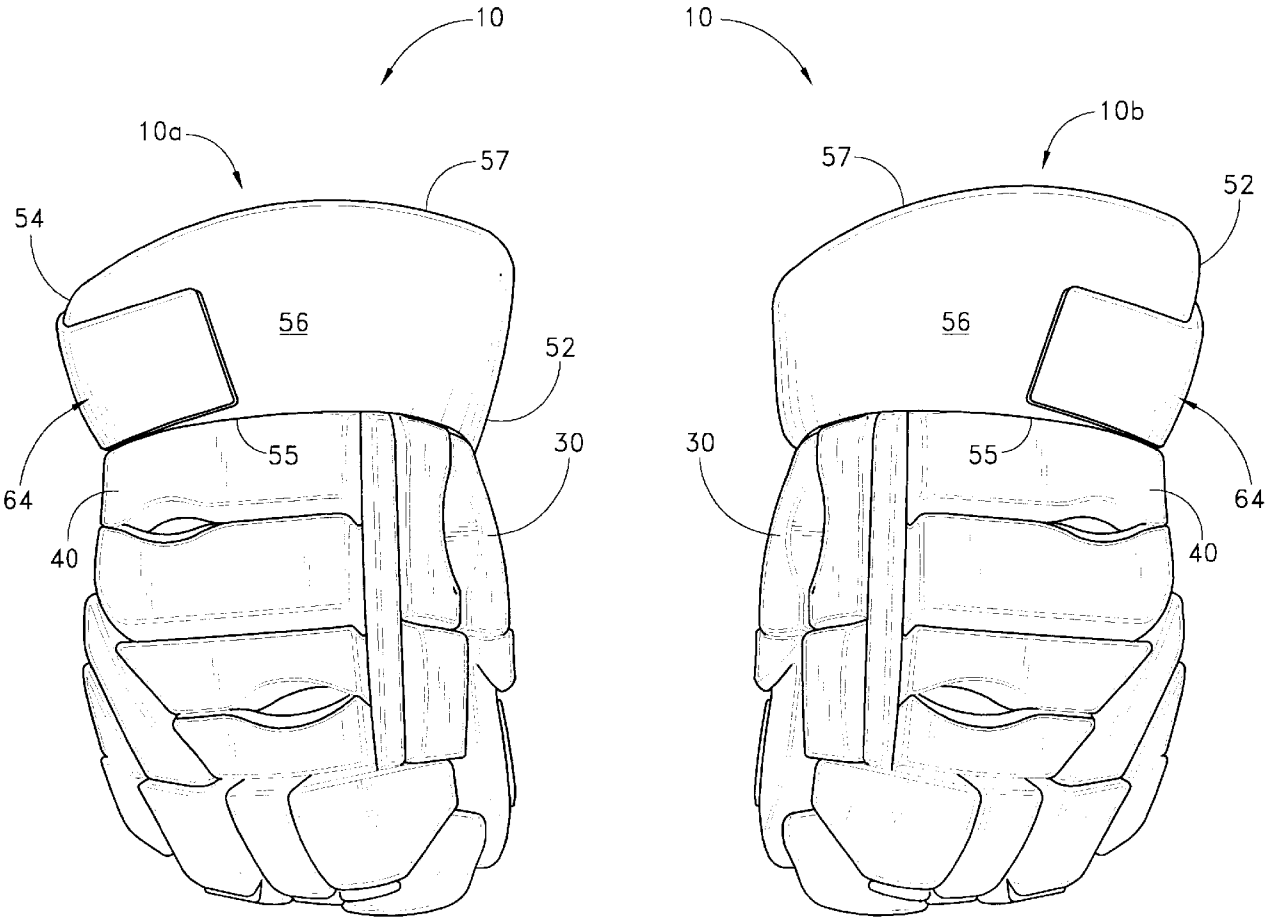
FIG. 9 illustrates an embodiment of a pair of gloves having attachable protectors attached and configured such that the right hand glove is a lower glove, and the left hand glove is an upper glove.
Figure 10:
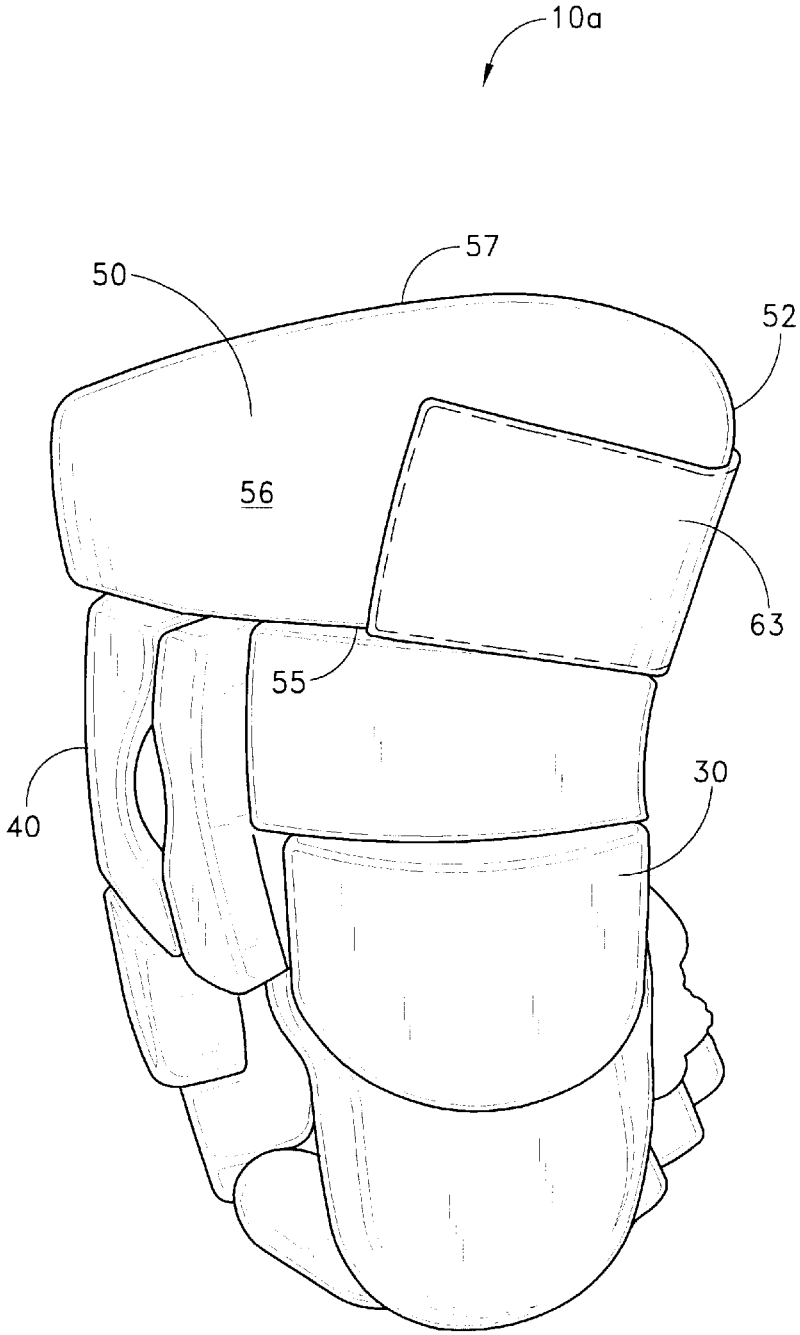
FIG. 10 is a side view of the right hand glove of FIG. 9.
Figure 11:
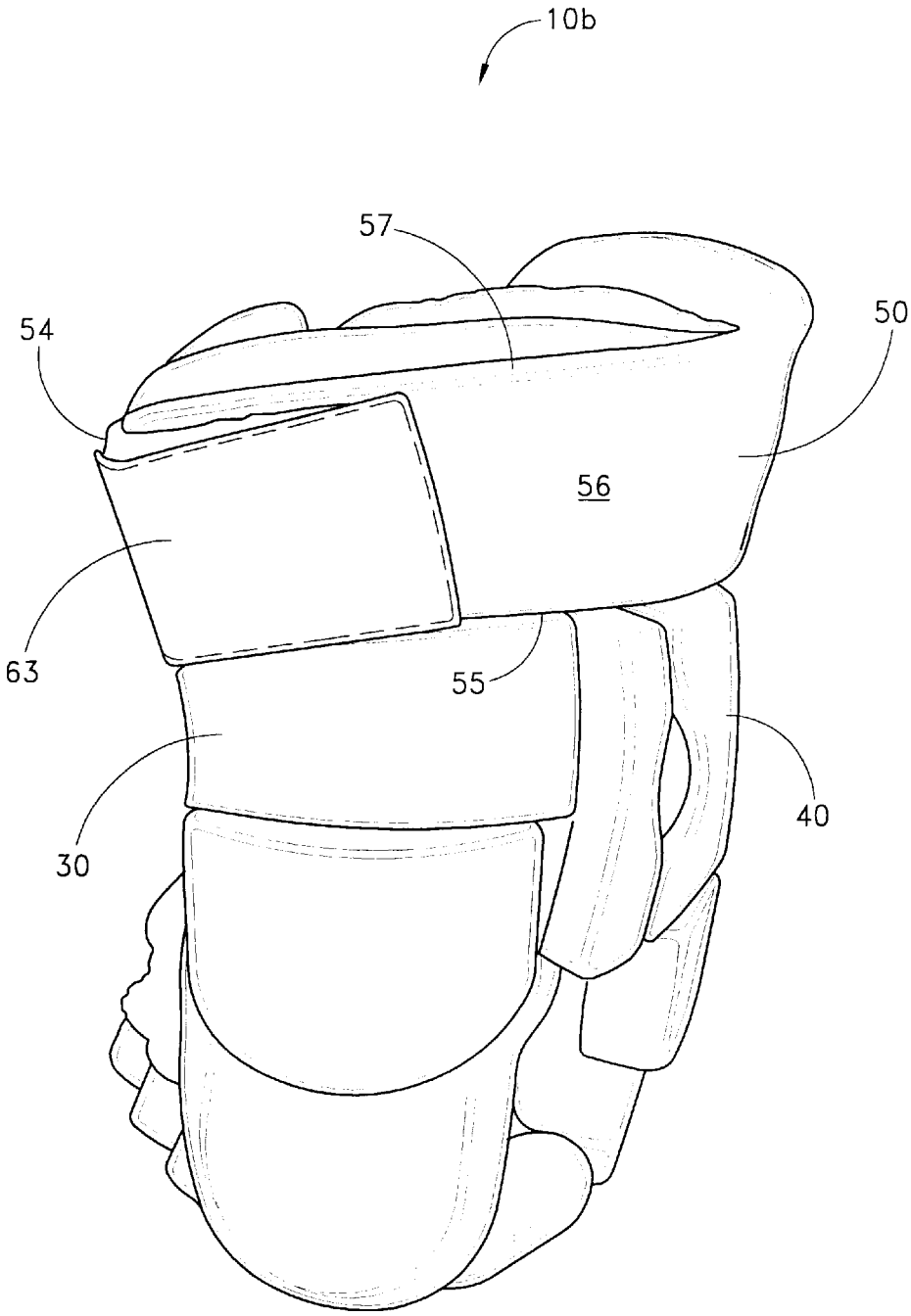
FIG. 11 is a side view of the left hand glove of FIG. 9.

With next reference to FIGS. 9–11, the gloves 10 of FIG. 3 are presented with the attachable protectors 50 attached in a different manner on their respective gloves 10. More specifically, the attachable protectors 50 are arranged in an arrangement customized for a right-handed hockey player.

With particular reference to FIGS. 9 and 10, for the right-handed glove 10*a*, the first end 52 of the attachable protector 50 is engaged with the thumb mount 63 and the second end 54 of the attachable protector 50 is engaged with the back mount 64. The first surface 56 of the attachable protector 50 faces outward and the first edge 55 is adjacent the back 40 of the glove 10. The second edge 57 of the attachable protector 50 is disposed generally adjacent the proximal end of the glove 10. The curvature of the second edge 57 varies the width of the attachable protector 50, and thus the protector's first end 52 extends proximally further than its second end 54. As such, more protection is provided along the wrists and cuff in the thumb area 30 than around the back area 40.

With particular reference to FIGS. 9 and 11, for the left-handed glove 10*b*, the first end 52 of the attachable protector 50 is engaged with the back mount 64 and the second end 54 of the attachable protector 50 is engaged with the thumb mount 63. As such, the first surface 56 of the attachable protector 50 faces outwardly and the first edge 55 is adjacent the back 40 of the glove. The curvature of the second edge 57 varies the width of the attachable protector 50 and thus the protector's first end 52 extends proximally further than its second end 54. As such, the left-handed glove 10*b* has more protection for the wrist and cuff adjacent the back 40 of the glove than it does adjacent the thumb 30.

As discussed above, a right-handed hockey player tends to grasp the stick towards its butt with the left hand while the player's right hand grasps the stick along the shaft toward the blade. The lower, right hand is wrapped around the stick with the palm facing generally upward and slightly to the side; the upper, left hand typically has its palm facing generally downward. As such, the palm and thumb portions of the right hand and wrist are most exposed to injury from a slashing competitor, and the back portion of the left hand and wrist are most exposed to such injury. In the embodiment illustrated in FIGS. 9–11, the attachable protectors are configured to offer the maximum level of protection at the most likely places of impact for a right-handed player.

The removable nature of the attachable protectors 50 allows a player to customize the fit, function, and feel of their gloves 10 to best suit their playing style. Moreover, a sports glove system can use the principles disclosed herein to provide improved versatility and customizability of the gloves.

In the illustrated embodiment, the glove mounts 63,64 have been placed on the cuff 14 and adjacent the back 40 and thumb 30 of the gloves, respectively. However, it will be understood that in additional embodiments the glove mounts 63,64 can be placed anywhere as desired to customize the fit and padding characteristics of the gloves 10. Also, additional embodiments may not place the attachment device on the cuff 14, but may attach the attachable protector 50 directly onto the back 40, palm 16, thumb 30 or other locations on or around the glove 10.

For example, a player may desire to increase the gloves initial level of protection at a location generally between the thumb and the first finger, also referred to as the wart. Accordingly, glove mounts 62 can be strategically positioned at particular locations, for example, on the palm generally in between the thumb 30 and first finger, and another on the side cuff 14*b*. This mounting portion 60 location allows a player to attach an additional protector 50 at a specific location between the thumb and first finger. Moreover, the attachable protectors 50 can be customized with the desired dimensions, such as width, length, thickness, and shape, to provide the desired level of comfort and protection.

The attachable protectors 50 need not be limited to a uniform thickness, but can have varying thicknesses. For example, different padding materials have unique characteristics. Therefore, an attachable protector 50 formed of a softer, more pliant, material typically will be thicker than one formed of a semi-rigid material in order to provide an equivalent level of protection. Still further, thickness can vary within an attachable protector.

In an additional embodiment, the attachable protectors 50 are substantially rigid. For example, they may be formed of any of a number of suitable polymers offering a resistance to cold and impact, such as, for example, polyurethane. Furthermore, in order to allow the attachable protectors 50 to flex and conform to the contours of the glove, they can be segmented, such as by providing break lines or overlapping segments that allow the attachable protector 50 to be contoured. The rigid attachable protectors 50 can be formed by any suitable method, such as molding or casting. They may additionally be filled with a lightweight shock absorbing material, such as any of a number of different types of foam, for example, expanded polypropylene (EPP).

Additionally, an attachable protector 50 need not be formed of a single material. Some embodiments incorporate a plurality of different material types arranged at strategic locations to provide both adequate protection and maneuverability. For example, an attachable protector 50 can be comprised of a first rigid or semi-rigid material having a desired thickness at the likely locations of impact, such as near the wider first end 52, and may further contain a softer, more supple, material at other locations to provide the desired ease of motion to allow a player's hand to move freely within the glove. Such variations in material used can also be accompanied with variations in the thickness of the attachable protector.

In the illustrated embodiment of FIGS. 4 and 5, the attachable protector 50 comprises padding that is covered with a suitable material, such as, for example, nylon. Other materials, such as leather, other textiles, or polymeric materials can be substituted or combined to provide durability to the attachable protectors 50. Moreover, the attachable protectors 50, or the applied covering, can be colored, as desired, to create an appealing color scheme.

Many players are conscientious about the fashion statement their equipment makes. For example, hockey goalies will often paint their helmets in an appealing paint scheme. Consequently, within the sporting equipment industry, the manufacturers of competitive sporting gear are typically sensitive to the demands of fashion in an effort to better promote and sell their gear. Accordingly, the attachable protector 50 can be fanciful, as desired. For example, the padding may be covered with a material that offers a high gloss or sheen. Alternatively, specific colors or patterns may be applied as desired. Furthermore, surface textures can add to the aesthetics of the attachable protectors 50. In short, the attachable protectors 50 can be decorated as desired to satisfy the whims of the fashion conscious including team colors, logos, advertisements and the like.

In accordance with one embodiment, a kit or system is provided wherein multiple sets of attachable protectors 50, each having different graphical characteristics, are provided. As such, a player may easily change the graphical scheme of his gloves simply by switching to a different set of attachable protectors 50.

In the illustrated embodiment, the attachable protectors 50 are asymmetrical about the center axis. As such, the overall configuration of the associated glove 10 changes depending on which attachable protector 50 surface faces outwardly. In another embodiment, the attachable protectors 50 can be generally symmetrical about the center axis, and the surfaces can have different graphical designs and/or colors. As such, when the wearer changes the orientation of the attachable protectors 50 so as to change which surface faces outwardly, the glove's padding characteristics remain generally the same, but the color or graphical scheme of the gloves is quickly and easily changed.

Figure 12:
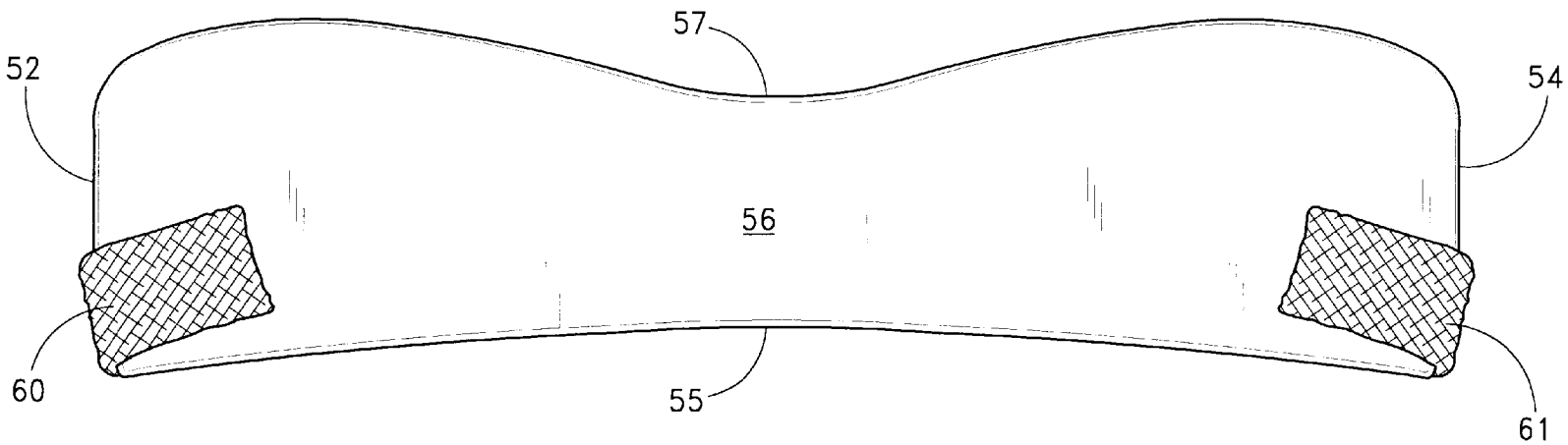
FIG. 12 illustrates another embodiment of an attachable protector.

With reference to FIG. 12, an additional embodiment of an attachable protector includes a first end 52, a second end 54, and a first surface 56. This embodiment is substantially symmetrical about an axis located midway between the first and second ends 52, 54. The attachable protector 50 is narrow along the axis, and generally widens toward both of the first end 52 and second end 54.

A first mounting portion 60 is disposed toward the first end 52 on the first surface 56 and wraps around the first end 52 and is further disposed on the second surface 58. Additionally, a second mounting portion 61 is disposed on the first surface 56 toward the second end 54 and wraps around the second end 54 and is attached to the second surface 58.

This particular embodiment provides similar zones of protection whether the first surface 56 or second surface 58 is facing outwardly. This embodiment is configured to offer customizability by altering which surface is facing outwardly. For example, the first surface 56 may be formed substantially of padding, while the second surface may have a rigid layer disposed on the surface or beneath the surface which offers increased protection. Alternatively, the first surface 56 may be colored differently than the second surface 58.

In the illustrated embodiments of the attachable protectors 50 of FIGS. 4, 5, 8, 9 and 12, the attachable protector 50 first end 52 is attached to the back mount 64, while the second end 54 is attached to the thumb mount 63. However, it will be readily apparent to one of ordinary skill in the art that the illustrated attachable protectors 50 and glove mounts 63,64 are examplary of the numerous embodiments of a sports glove system incorporating the principles disclosed herein.

As discussed above, in other embodiments, attachable protectors 50 can be provided in various shapes and sizes, both asymmetrical and symmetrical, and can have various properties with regard to stiffness, flexibility, thickness, amount of padding and the like. For example, a player may prefer attachable protectors 50 with a greater width than shown in the illustrated embodiments. Another player may prefer a more streamlined, narrower design. Still further, a player may prefer a first attachable protector 50 configuration when playing defense and a second attachable protector 50 configuration when playing offense. Such a desire can thus be met by simply changing from one pair of attachable protectors 50 to another pair of attachable protectors 50 when changing playing positions.

Additionally, a player not need use multiple pairs of attachable protectors 50, but could simply switch the attachable protectors 50 to show their second surface 58 rather than their first surface 56, or vice versa, to vary the protection offered by the attachable protectors 50. For example, attachable protectors 50 can be configured with a first surface 56 having a rigid covering, while the second surface 58 can be more resilient padding.

Additionally, a player may use an attachable protector 50 having a desired set of properties for one glove 10, and a second attachable protector 50 having a differing set of properties for the other glove 10. For example, a player's thumb may be particularly susceptible to injury, and thus the player prefers to use an attachable protector offering rigid protection to the player's thumb, while other areas of the same glove, or the other glove, do not require such rigid protection and thus have attachable protectors 50 configured with padding. In this embodiment, the attachable protector used with one glove has different properties than the attachable protector on the other glove.

Attachable protectors 50 need not be limited to use only in hockey. As described above, gloves and glove systems employing the principles discussed herein can be used for other sports such as, for example, Lacrosse, roller hockey, and field hockey. In any such sport, the attachable protectors 50 will enable players to customize their gloves for a particular position, playing style, team color, graphical preference, stiffness, padding volume or the like. It is to be understood, however, that other sports may not necessarily have the same "upper" and "lower" glove roles as discussed above for hockey. As such, placement of the attachable protector 50 can be adjusted as desired.

In the illustrated embodiments the attachable protectors 50 are depicted as relatively small and oriented to protect the area of a wearer's wrist or arm adjacent the hand. In additional embodiments, attachable protectors can comprise or be linked to additional protection equipment such as, for example, arm protectors or the like.

It is to be further understood that various types of fasteners and fastening methods and devices can be used to removably secure the attachable protector 50 onto the glove, and should not be limited to the examplary hook and loop fastener described. For example, other suitable fastening systems and methods may include snaps, hooks, buttons, zippers, magnets, clips, heat bonding, and any other suitable structure that connects the attachable protector 50 to the glove.

The illustrated embodiments of FIGS. 9–11 show the attachable protectors 50 connected at only two locations, and resulting in a floating protector. That is, while the ends of the attachable protector 50 are attached to the glove 10, the portion of the attachable protector 50 in between the ends is movable in a direction substantially parallel with the longitudinal axis of the glove, thereby allowing a fuller range of a player's wrist motion than if the attachable protector 50 were secured substantially along its length. Of course, although the attachable protectors 50 in the illustrated embodiment are secured in place at only two locations, other embodiments secure the attachable protectors 50 to the glove at more or less locations, as appropriate, thus resulting in varying attachment schemes and glove characteristics.

In an additional embodiment, the glove mounts, such as the thumb mount 63 and back mount 64, are constructed with the free portion 66 formed of elastic. In this embodiment, the attachable protector 50 is given a degree of mobility about the glove. This can be especially useful where the attachable protector 50 is substantially rigid and a floating protector is desired. A substantially rigid protector will not deform in response to hand and wrist movements, and in some cases, can make hand and wrist motions difficult. By providing an elastic attachment, hand and wrist movements are restricted less by the attachable protector 50.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A sports glove system comprising:

a right glove and a left glove, each glove comprising a palm, a protective back extending over the palm and comprising padding, and a glove attachment member;

a plurality of attachable protectors formed separately from the gloves, each of the attachable protectors comprising a first surface, a second surface, and an attachment member configured to cooperate with the glove attachment member to selectively and releasably hold the attachable protector onto the respective glove in a first orientation in which the attachable protector presents a first characteristic or in a second orientation in which the attachable protector presents a second characteristic, each of the attachable protectors having a first surface and a second surface, each attachable protector being configured so that the first surface faces outwardly when the protector is held on the respective glove in the first orientation, and the second surface faces outwardly when the protector is held on the respective glove in the second orientation.

2. The glove system of claim 1, wherein the first and second surfaces have different graphical characteristics.

3. The glove system of claim 1, comprising a plurality of pairs of attachable protectors.

4. The glove system of claim 3, wherein a first pair of attachable protectors has a different shape than a second pair of attachable protectors.

5. The glove system of claim 3, wherein a first pair of attachable protectors has a different stiffness than a second pair of attachable protectors.

6. The glove system of claim 3, wherein a first pair of attachable protectors comprises a different graphical design than a second pair of attachable protectors.

7. The glove system of claim 1, wherein each of the attachable protectors comprises a first end and a second end, and the attachable protectors are asymmetrical about a midpoint between the first and second ends.

8. The glove system of claim 7, wherein a first attachable protector has a width adjacent its first end that is greater than a width adjacent its second end.

9. The glove system of claim 8, wherein the first end of the first attachable protector is disposed generally adjacent a thumb of the respective glove when the protector is held to the glove in the first orientation.

10. The glove system of claim 9, wherein the second end of the first attachable protector is disposed generally adjacent the back of the respective glove when the protector is held to the glove in the first orientation.

11. A sports glove comprising a body having a palm, a back and a cuff, and an attachable protector configured to be selectively releasably connected to the body, the attachable protector having at least a first attachment member, first and second opposing surfaces, and first and second ends, the attachable protector covering at least a portion of the body, wherein the sports glove is configured so that the attachable protector can be selectively connected to the body with the first surface facing outwardly or with the second surface facing outwardly.

12. The sports glove of claim 11, wherein said first end of the attachable protector is thicker and/or wider than the second end.

13. The sports glove of claim 11, wherein said first and second surfaces of the attachable protector have different graphical characteristics.

14. The sports glove of claim 11, wherein the attachable protector extends around a portion of the cuff.

15. The sports glove of claim 11, wherein the attachable protector first end is connected to the cuff, and the second end is connected to the glove a distance away from the cuff.

16. A method of customizing a sports glove, comprising:

providing a glove having a palm and a protective back;

providing an attachable protector having opposing first and second surfaces and being configured for selective attachment to the glove in more than one orientation;

removably attaching the attachable protector to the glove so that the attachable protector is oriented in a first orientation wherein the first surface faces outwardly from the glove;

removing the attachable protector; and removably attaching the attachable protector to the glove so that the attachable protector is oriented in a second orientation wherein the second surface faces outwardly from the glove.

17. The method of claim 16, wherein the first and second surfaces have different graphical characteristics.

18. The method of claim 16, wherein the attachable protector has first and second ends, and the protector is asymetrical about a midpoint between the first and second ends, and a position of the first end relative to the glove when in the first orientation is different than when in the second orientation.

19. The method of claim 16, wherein the attachable protector has first and second ends, and the protector is asymetrical about a midpoint between the first and second ends, and a position of the first end relative to the glove when in the first orientation is substantially the same as when in the second orientation.

20. A sports glove system comprising:

a right glove and a left glove, each glove comprising a palm, a protective back extending over the palm and comprising padding, and a glove attachment member; and a plurality of attachable protectors formed separately from the gloves, each of the attachable protectors comprising an attachment member configured to cooperate with the glove attachment member to selectively and releasably hold the attachable protector onto the respective glove in a first orientation in which the attachable protector presents a first characteristic or in a second orientation in which the attachable protector presents a second characteristic;

wherein each of the attachable protectors comprises a first end and a second end, and the attachable protectors are asymmetrical about a midpoint between the first and second ends, a first attachable protector having a width adjacent its first end that is greater than a width adjacent its second end, the first end of the first attachable protector being generally adjacent a thumb of the respective glove when the protector is held to the glove in the first orientation, and the second end of the first attachable protector being disposed generally adjacent the back of the respective glove when the protector is held to the glove in the first orientation.

21. The glove system of claim 20, wherein each attachable protector has a first surface and a second surface, and the first attachable protector is configured so that a first surface faces away from the respective glove when the protector is held in the first orientation.

22. The glove system of claim 21, wherein the first and second surfaces of the first attachable protector have different graphical characteristics.

23. The glove system of claim 21, wherein a second surface of the first attachable protector faces away from the respective glove when the protector is held in the second orientation.

24. The glove system of claim 20, comprising a plurality of pairs of attachable protectors.

25. The glove system of claim 24, wherein a first pair of attachable protectors has a different shape than a second pair of attachable protectors.

26. The glove system of claim 24, wherein a first pair of attachable protectors has a different stiffness than a second pair of attachable protectors.

27. The glove system of claim 24, wherein a first pair of attachable protectors has a different graphical design than a second pair of attachable protectors.

28. The glove system of claim 20, wherein the second end of the first attachable protector is generally adjacent the thumb, and the first end of the first attachable protector is disposed generally adjacent the back when the protector is held in the second orientation.

29. The glove system of claim 28, wherein the attachable protector has a first surface and a second surface, and the first surface faces away from the glove when the first attachable protector is held in the first and second orientations.

30. The glove system of claim 28, the attachable protector has a first surface and a second surface, and wherein the first surface faces away from the glove when the first attachable protector is held in the first orientation and the second surface faces away from the glove when the first attachable protector is held in the second orientation.

* * * * *